US012522955B2

(12) United States Patent
Gehring

(10) Patent No.: US 12,522,955 B2
(45) Date of Patent: Jan. 13, 2026

(54) MACHINE CONTROLLER FOR CONTROLLING OPERATION OF A MACHINE OF A SPINNING MILL, AS WELL AS AN ELECTRONIC DEVICE AND A METHOD FOR UPDATING SUCH MACHINE CONTROLLERS

(71) Applicant: MASCHINENFABRIK RIETER AG, Winterthur (CH)

(72) Inventor: David Gehring, Henggart (CH)

(73) Assignee: Rieter AG, Winterthur (CH)

( * ) Notice: Subject to any disclaimer, the term of this patent is extended or adjusted under 35 U.S.C. 154(b) by 0 days.

(21) Appl. No.: 18/832,272

(22) PCT Filed: Jan. 23, 2023

(86) PCT No.: PCT/EP2023/051535
§ 371 (c)(1),
(2) Date: Jul. 23, 2024

(87) PCT Pub. No.: WO2023/144081
PCT Pub. Date: Aug. 3, 2023

(65) Prior Publication Data

US 2025/0101641 A1 Mar. 27, 2025

(30) Foreign Application Priority Data

Jan. 25, 2022 (EP) ..... 22153138

(51) Int. Cl.
*D01H 13/02* (2006.01)
*D01H 13/32* (2006.01)

(52) U.S. Cl.
CPC ..... *D01H 13/32* (2013.01)

(58) Field of Classification Search
CPC .... D01H 13/32; D01H 13/26; G05B 19/4184; G05B 19/4185
(Continued)

(56) References Cited

U.S. PATENT DOCUMENTS 5,517,404 A * 5/1996 Biber ..... D01H 13/32 700/130
5,801,949 A * 9/1998 Raasch ..... D01H 13/32 700/130
(Continued)

FOREIGN PATENT DOCUMENTS

CH 684952 A5 * 2/1995 ..... D01H 13/14
CN 111 880 497 A 11/2020
(Continued)

OTHER PUBLICATIONS

PCT Search Report, Mar. 14, 2023.
Introduction to Docker—https://www.slideshare.net/dotCloud/into-docker-october-2013.

*Primary Examiner* — Danny Worrell
(74) *Attorney, Agent, or Firm* — Dority & Manning, P.A.

(57) ABSTRACT

A machine controller for operation of a spinning mill machine includes a storage of an operating system code, container daemon code, and a plurality of container images. A processor section performs the following: provide a running operating system based on the operating system code; provide a running container daemon based on the container daemon code; and provide running containers based on the plurality of container images. The running operating system includes access functions for accessing the machine of the spinning mill and each one of a set of the running containers provides a service for controlling operation of the spinning mill machine. The running container daemon concurrently interfaces services of the running containers with access functions of the running operating system. The machine controller further includes an update service that updates the container images of the machine controller.

14 Claims, 4 Drawing Sheets

(58) Field of Classification Search
USPC ..... 700/130, 136, 137, 138, 139, 140, 141, 700/142, 143, 144
See application file for complete search history.

(56) References Cited

U.S. PATENT DOCUMENTS

| | | | | |
|---|---|---|---|---|
| 6,694,211 | B2 * | 2/2004 | Hosel | G05B 19/409 112/155 |
| 11,977,371 | B2 * | 5/2024 | Blaser | B65H 67/063 |
| 12,152,327 | B2 * | 11/2024 | Atsumi | D05B 19/08 |
| 2002/0095235 | A1 | 7/2002 | Hosel | |
| 2020/0233403 | A1 | 7/2020 | Gelbke et al. | |
| 2024/0185314 | A1 * | 6/2024 | Adam | G06Q 30/0601 |
| 2025/0101641 | A1 * | 3/2025 | Gehring | D01H 13/32 |

FOREIGN PATENT DOCUMENTS

| | | | | |
|---|---|---|---|---|
| DE | 3906508 | A1 * | 9/1989 | |
| DE | 4113384 | A1 * | 11/1991 | |
| DE | 4229234 | A1 * | 3/1993 | D01G 31/006 |
| DE | 10 2007 052 677 | A1 | 5/2009 | |
| EP | 0497535 | A1 * | 5/1992 | |
| EP | 2279462 | B1 * | 7/2015 | G05B 19/0421 |
| WO | WO-9213121 | A1 * | 8/1992 | C21D 9/561 |

* cited by examiner

MACHINE CONTROLLER FOR CONTROLLING OPERATION OF A MACHINE OF A SPINNING MILL, AS WELL AS AN ELECTRONIC DEVICE AND A METHOD FOR UPDATING SUCH MACHINE CONTROLLERS

FIELD OF INVENTION

The present disclosure relates to a machine controller for controlling operation of a machine of a spinning mill. More specifically, the present disclosure relates to a machine controller for controlling operation of a machine of a spinning mill which simplifies updating. The present disclosure further relates to an electronic device and a method for updating such machine controllers.

BACKGROUND

Spinning mills include large numbers of machines, in particular textile machines, for converting natural and man-made fibers and their blends into yarns of desired quantities and qualities. Beside textile machines, spinning mills include further machines for operating the spinning mills, such as robots for performing maintenance at textile machines, air-conditioning systems for controlling temperature and/or humidity in a spinning mill, etc. Machines of a spinning mill include or have assigned machine controllers for controlling operation of the machines of the spinning mill. Each machine of a spinning mill may have included or assigned at least one or several machine controllers, or a machine controller may control operation of several machines of a spinning mill. Groups of machine controllers may have assigned one or more superordinated machine controllers.

Machine controllers include non-volatile storage for storing program instructions respectively software, as well as one or more processors and volatile memory for loading and running program instructions respectively software stored in the non-volatile storage, which program instructions respectively software control operation of a respective machine of a spinning mill in accordance with a predefined control scheme, such as setting a rotation speed of a ring spinning machine in accordance with a quality parameter of textile material, recording of a doff time, etc. The non-volatile storage may relate to HDDs (Hard Disk Drives), SSDs (Solid State Disks), etc. The processors and volatile memory may relate to CPUs (Central Processing Units) and RAM (Random Access Memory) modules, GPUs (Graphics Processing Units), microcontrollers, etc. In some embodiments, program instructions respectively software include operating system code and an application program code. Operating system code may relate to a UNIX® operating system, a Linux® operating system, a Windows® operating system, a MacOS® operating system, etc. Operating system code includes program instructions respectively software relating to functions for accessing machines of a spinning mill, for example, application programming interfaces (APIs), libraries, etc. Application program code includes functions for controlling operation of machines of a spinning mill on the basis of functions provided by operating system code, such as application programming interfaces (APIs), libraries, etc., such as reading a quality parameter of textile material on the basis of functions of the operating system code for accessing a sensor of a machine, setting a rotation speed on the basis of functions of the operating system code for accessing an actor of a machine, recording a doff time on the basis of functions of the operating system code for accessing a sensor or an actor of a machine, etc.

An application program for controlling operation of a machine of a spinning mill includes a wide variety of functions, for example, functions related to recipe management, user management, log collection, alert management, notification functions, shift functions, etc. Functions included in an application program depend on each other, for example functions related to user management are required to properly assign recipe management rights to a particular user. Because of inter-dependencies of functions of an application program, an application program cannot be easily subdivided into several different application programs. Furthermore, for improving control of operation of machines of a spinning mill, for example as regards updated recipe rules, an application program evolves with time, for example over several years. Because of possible difficulties when updating a running application program, an update of the application program is performed manually and only executed when really required. Furthermore, software developers also don't want to touch "old code", because the effect of modifications often is difficult to assess.

DE102007052677A1 relates to a method for operating a textile machine having a plurality of work stations. The work stations each comprise a plurality of individual components, such as a thread laying device, a thread connecting device or a thread forming device and a thread monitoring device or thread cleaning device. Component-specific software is stored in each of the components, by means of which the components are controlled or regulated. A query of the components and the associated component-specific software with regard to their compatibility via a central control device of the textile machine is carried out. If an incompatibility of software and components or components and jobs is found, the software is updated, provided that it is disponible from a database stored in a memory associated with the central control device.

US2002095235A1 discloses a control system for a group of fiber processing machines, which includes a superordinated control console and separate machine-specific control consoles. The superordinated control console is utilized for those inputs and displays which require no personal control and display acknowledgment, and the machine-specific control consoles are utilized only for those inputs and displays which require a personal control and display acknowledgement. The superordinated control console is connected to a communication network to make it possible to call for external information or to transfer data thereto (telephone service for problem searching, technical support, updates).

CN111880497A discloses a container-based intelligent manufacturing equipment control system comprising a cloud server, local equipment and an equipment supplier. According to the invention, an original centralized equipment control system is divided into mutually isolated lightweight containers, the containers cooperate with each other to realize a complete function of the system, and the high reusability of the containers is adopted, so that computing resources occupied by a copy of the system are reduced, the performance requirement of server is reduced, and the stability of the system is improved.

US2020233403A1 discloses an edge device for a network comprising: a connection for one or more production devices; and a processor adapted to run a plurality of microservices each comprising an artifact adapted for accessing an analytics database. The analytics database is shared between microservices. The edge device is adapted to access measurement information pertaining to the one or more production devices. The measurement information is stored in a measurement database that is separate from the analytics database.

Intro Docker October 2013 (https:/(www.slideshare.net/dotCloud/intro-docker-october-2013) discloses a shipping container system for code. An engine enables any payload to be encapsulated as a lightweight, portable, self-sufficient container that can be manipulated using standard operations and run consistently on virtually any hardware platform.

BRIEF SUMMARY OF THE INVENTION

There may be a need for a machine controller for controlling operation of machines of a spinning mill which simplifies updating, as well as an electronic device and a method enabling simplified updating of such machine controllers. There may be a need for a machine controller for controlling operation of machines of a spinning mill which simplifies making use of an existing operating system. There may be a need for a machine controller for controlling operation of machines of a spinning mill which simplifies adaption to a new release of an operating system.

Such a need may be met by the subject-matter of the independent claims. Advantageous embodiments are defined in the dependent claims.

An aspect of the invention relates to a machine controller for controlling operation of a machine of a spinning mill. The machine controller comprises a storage storing operating system code, container daemon code and a plurality of container images, and a processor section. The processor section is configured to provide a running operating system based on the operating system code, and to provide a running container daemon based on the container daemon code, and to provide running containers based on the plurality of container images. The running operating system includes access functions for accessing the machine of the spinning mill. Each one of a set of the running containers provides a service for controlling operation of the machine of the spinning mill. The running container daemon concurrently interfaces services of the set of the running containers with access functions of the running operating system for controlling operation of the machine of the spinning mill by the set of the running containers. The container-daemon can be designed to interface services of the containers with access functions of a particular operating system, such as Windows®, MacOS®, Linux®, etc. of a particular release. For example, in case of an existing operating system, it is sufficient to provide a respectively designed container daemon for interfacing the containers with the operating system, while the containers can remain unchanged. For example, in case of a new release of the operating system, it is sufficient to provide a respectively updated container daemon for interfacing the containers with the new release of the operating system, while the containers can remain unchanged, The machine controller further includes an update service for updating container images of the machine controller. Running containers enable providing services which are independent from each other. For example, a service provided by one running container may relate to recipe management, while a service provided by another running container may relate to log collection. In case of the need for updated services, such as updated recipe management or log collection, only respective container images need to be updated, which simplifies updating the machine controller. For example, the update service is an automated update service which automatically stores updated container images upon receipt for automatically providing updated running containers based on the updated container images.

In some embodiments, the update service enables of a push service and/or a pull service for updating container images. An electronic device according to the present disclosure enables pushing updated container images from the electronic device to one or more machine controllers and/or pulling updated container images at one or more machine controllers from the electronic device. Accordingly, DevOps practices (Dev: Development; Ops: Operations) are enabled. Furthermore, CI/CD practices (CI: continuous integration; CD: continuous delivery or deployment) are enabled.

In some embodiments, the update service enables stopping a running container, starting a container image for providing a respective running container, restarting a running container in particular after updating the respective container image, perform a predefined verification after starting a container image, and/or perform a predefined verification after restarting a running container image. For example, updating a container image while a respective running container is still active is enabled. For example, switching from a previously running container to an updated running container is enabled.

In some embodiments, the update service is a part of the running operating system, the running container daemon, and/or one or more of the running containers. Implementing the update service in accordance with predefined specifications is enabled.

In some embodiments, one or more of a further set of running containers provide services for operating and/or administering container images, container daemon code, operating system code, the running containers, the running container daemon, the running operating system, and/or the machine of the spinning mill. For example, running container images enable operating and/or administering the machine controller.

In some embodiments, one or more running containers provide a service for basic machine control, recipe management, user management, log collection, alerts, notifications, shift service, or distributed processing. Adapting the services of the running containers to various demands for controlling operation of a machine of a spinning mill is enabled.

In some embodiments, one or more running containers provide a service for controlling operation of a bale opener machine, a blow room machine, a card machine, a draw frame machine, a comber machine, a roving frame machine, a ring spinning machine, a compact spinning machine, a rotor spinning machine, an air-jet spinning machine, an automation machine, a winding machine, or a texturing machine. Adapting the services of the running containers to control various types of textile machines of a spinning mill is enabled.

In some embodiments, the operating system is a UNIX®, a Linux®, a Windows®, or a MacOS® operating system or kernel, or a virtualization thereof. Using widely available technology is enabled for building the machine controller.

In some embodiments, the container daemon code and the container images comply with Open Container Initiative, DOCKER® (open-source container management application), APPC (Advanced Program-to-Program Communication), LXD® (Learning Experience Design open-source container and virtual machine management system), CRI-O® (an open source, community-driven container engine), Railcar™ (tracking and management software), RKT™ (an application container engine), LXC (Linux Containers) or CNCFR (Cloud Native Computing Foundation). Using widely available technology is enabled for building the container daemon code and the container images.

In some embodiments, running containers provide for a service-oriented architecture and/or an event-driven architecture. Flexibly designed the machine controller in accordance with predefined architectures is enabled. A service-oriented architecture (SOA) is an architectural style that focuses on discrete services instead of a monolithic design (https://en.wikipedia.org/wiki/Service-oriented architecture). An event-driven architecture (EDA) is a software architecture paradigm promoting the production, detection, consumption of, and reaction to events (https://en.wikipedia.org/wiki/Event-driven_architecture).

The invention further relates to an electronic device for updating container images of machine controllers according to the present disclosure of machines of a spinning mill. The electronic device is configured to cooperate with one or more update services of respective machine controllers and to access a container repository of the electronic device for updating respective container images of machine controllers. The electronic device simplifies updating of machine controllers, because of enabling updating a plurality of machine controllers.

In some embodiments, accessing the container repository of the electronic device is based on a version number of container images, a type identifier of respective machine controllers and/or a version number of respective machine controllers. Adapting updating the machine controllers to various scenarios is enabled.

In some embodiments, the electronic device is configured to update respective container images upon receipt of updated container images at the container repository of the electronic device. Updating container images as soon as they become available is enabled.

In some embodiments, the electronic device is configured to update respective container images upon request from machine controllers. For example, checking at regular time intervals for updates is enabled.

The invention further relates to a method for updating container images of machine controllers of machines of a spinning mill. The method comprises at an electronic device according to the present disclosure: cooperating with one or more update services of machine controllers according to the present disclosure, and accessing the container repository of the electronic device for updating respective container images of machine controllers.

In some embodiments, accessing the container repository of the electronic device is based on one or more of a version number of container images, a type identifier of respective machine controllers and a version number of respective machine controllers.

BRIEF DESCRIPTION OF DRAWINGS

The invention will be better understood with the aid of the description of an embodiment given by way of example an illustrated by the figures, in which.

DETAILED DESCRIPTION OF THE INVENTION

Figure 1:
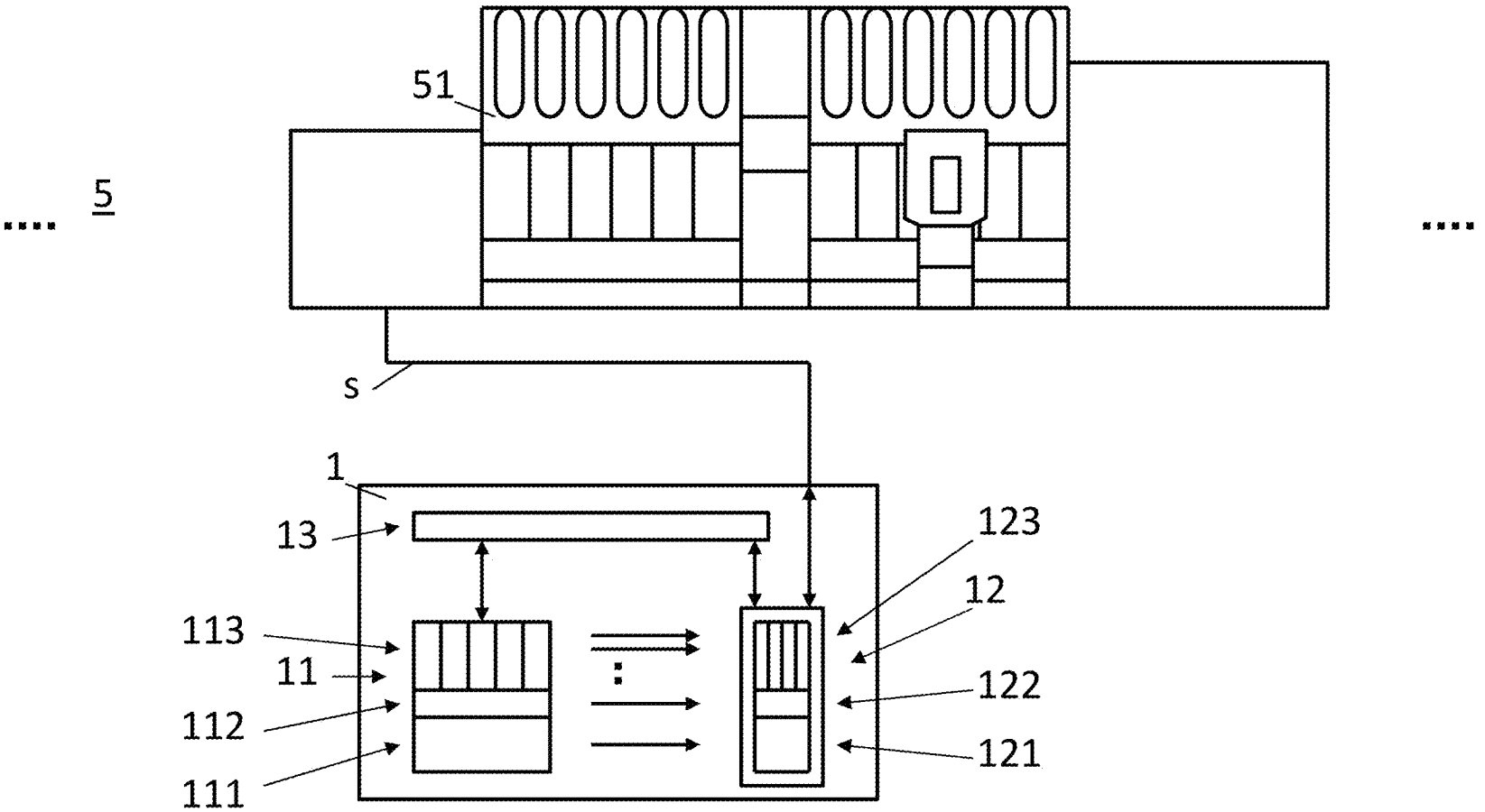
FIG. 1 schematically illustrates a machine controller for controlling operation of a machine of a spinning mill.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 schematically illustrates a machine controller 1 according to the present invention for controlling operation of a machine 51 of a spinning mill 5. For example, as schematically illustrated in FIG. 1, the machine 51 relates to a ring spinning machine. However, the present disclosure is not limited to any particular type of a machine of a spinning mill and also relates to, for example, bale opener machines, blow room machines, draw frame machines, rowing frame machines, air jet spinning machines, robots, air-conditioning systems, etc. In some embodiments, as illustrated in FIG. 1, the machine controller 1 is arranged externally from the machine 51 of the spinning mill 5, and is connected via a signal line(s) with the machine 51 of the spinning mill 5. The signal line(s) may relate to a wired or wireless signal line for transmitting electronic signals and/or electronic messages between the machine 51 of the spinning mill 5 and the machine controller 1 for controlling operation of the machine 51 of the spinning mill 5. In other embodiments (not illustrated in FIG. 1), the machine controller 1 is a part of or is attached to the machine 51 of the spinning mill 5. In some embodiments, as illustrated in FIG. 1 with dotted lines, the textile machine 51 is a part of a spinning mill 5 which typically comprises a plurality of textile machines and other machines. In some embodiments, the machine 51 of the spinning mill 5 is a textile machine which receives textile material from an upstream textile machine (not illustrated in FIG. 1), and which delivers processed textile material to a downstream textile machine (not illustrated in FIG. 1).

As illustrated in FIG. 1, the machine controller 1 includes a storage 11. The storage 11 has stored operating system code 111, container daemon code 112 and a plurality of container images 113. For example, the storage 11 relates to a HDD (hard disk drive), to an SSD (solid state disk), etc., or any combination thereof, i.e., to a non-volatile storage. In some embodiments, the storage 11 is arranged remote from the machine controller 1, wherein the machine controller 1 has access to the remotely arranged storage 11 via a network, for example.

In some embodiments, operating system code 111 relates to a UNIX® operating system, to a Linux operating system, to a Windows® operating system, to a MacOS® operating system, to a kernel of such an operating system, to any other operating system, or to a virtualization thereof. In case the operating system code relates to a kernel, typical operating system functions such as networking may be provided by running containers 123 (running containers 123 will be described further below). A virtualization of an operating system is based on a hypervisor and/or a virtual machine which run the virtualization/emulation of an operating system for providing functionalities of the operating system. For example, a virtual machine may run on a Linux operating system, wherein within the virtual machine a Windows® operating system may be run for providing functionalities of the Windows® operating system, for example for running application programs which are designed for the Windows® operating system. In some embodiments, the operating system is an operating system as available at the filing date of the present disclosure. In some embodiments, the virtual machine is a virtual machine as available at the filing date of the present disclosure. In some embodiments, the operating system code 111 relates to a stripped-down version which provides only required access functions, in particular in order to avoid the need to update the operating system code 111. In some embodiments, the operating system code 111 includes executable programs, libraries, configuration files, etc.

In some embodiments, container daemon code 112 and the container images 113 relate to Open Container Initiative, DOCKER® (open-source container management application), APPC (Advanced Program-to-Program Communication), LXD® (Learning Experience Design open-source container and virtual machine management system), CRI-O® (an open source, community-driven container engine), Railcar™ (tracking and management software), RKT™ (an application container engine), LXC (Linux Containers) or CNCFR (Cloud Native Computing Foundation). In other embodiments, container daemon code 112 and the container images 113 relate to any other technology providing the functionalities as described in the present disclosure. In some embodiments, container daemon code 112 relates to container daemon code as available at the filing date of the present disclosure. In some embodiments, the container images 113 relate to container images as available at the filing date of the present disclosure. Each one of the container images 113 is configured to provide a service for controlling operation of the machine 51 of the spinning mill 5, as will be described in more detail below. Container images may include different versions of a particular service. In some embodiments, the container daemon code 112 and/or the container images 113 include executable programs, libraries, configuration files, etc. In some embodiments, the container images 113 are self-contained.

As illustrated in FIG. 1, the machine controller 1 includes a processor section 12. The processor section 12 is configured to provide a running operating system 121 based on the operating system code 111, and to provide a running container daemon 122 based on the container daemon code 112, and to provide one or more running containers 123 based on one or more of the plurality of container images 113. In some embodiments, the processor section 12 includes one or more processors and a volatile memory. In some embodiments, the one or more processors relate to one or more CPUs (central processing unit), GPUs (Graphics Processing Units), microcontrollers, etc., or a combination thereof. In some embodiments, the volatile memory relates to a RAM (random access memory) module. The processor section 12 is configured to load and run operation system code 111, container daemon code 112 and container images 113 in order to provide a running operating system 121, a running container daemon 122 and running containers 123. For example, the running containers 123 run on top of and/or make use of the running container daemon 122, which runs on top of and/or makes use of the running operation system 121.

The processor section 12 may include or may be connected to further electronic circuits, such as network interfaces, logic boards, etc., for providing functions described in the present disclosure. For example, electronic circuits such as network interfaces may provide functions for connecting with the machine 51 of the spinning mill 5 for accessing the machine 51, for example for accessing sensors and/or actors of the machine 51.

The running operating system 121 includes access functions for accessing the machine 51, in particular for accessing sensors and/or actors of the machine 51.

For example, the running operating system 121 includes access functions for setting machine parameters of the machine 51, such as setting an actor signal, for example for setting a rotation speed. For example, the running operating system 121 includes access functions for reading machine parameters of the machine 51, such as reading a sensor signal, for example for reading a doff time. In some embodiments, the operating system includes respective application programming interfaces (APIs), libraries, etc. which provide access functions for accessing the machine 51. In some embodiments, such APIs, libraries, etc. are designed in accordance with a machine type of the machine 51. For example, other APIs, libraries, etc. may be involved for controlling operation of a draw frame machine than for controlling operation of a ring spinning machine.

Each one of a set of the running containers 123 provides a service for controlling operation of the machine 51 of the spinning mill 5. The set of running containers 123 may include one or more running containers 123. Typically, the set of running containers 123 includes a plurality of running containers 123. In some embodiments, services of running containers 123 relate to recipe management, user management, log collection, alerts, notifications, shift service, and/or distributed processing. In some embodiments, services of running containers 123 relate to controlling operation of a bale opener machine, a blow room machine, a card machine, a draw frame machine, a comber machine, a roving frame machine, a ring spinning machine, a compact spinning machine, a rotor spinning machine, an air-jet spinning machine, an automation machine, a winding machine, and/or a texturing machine. For example, one of the running containers 123 may relate solely to recipe management, while another one of the running containers 123 may relate solely to log collection. For example, running containers 123 may be shut down when not needed, and restarted when needed. For example, a running container 123 relating to log collection may only be provided when log collection services are required, for example at regular time intervals.

In some embodiments, one or more of a further set of running containers 123 provide services for operating and/or administering the container images 113, container daemon code 112, running container images 123, running container daemon 122, the machine 51, etc. For example, a running container 123 may provide services in the form of a watchdog to regularly verify a status of running containers 123. For example, a running container 123 may provide services to check for available updates for container images (e.g. form a repository within the mill (edge) or within the internet (cloud)), to check on known security threats by querying a database on edge or on cloud containing known security threads, to analyze traffic between the containers or between the container and the mill network for checking network performance (throughput, round-trip-times, etc.) and/or for scanning for open ports and/or for analyzing the open ports for security threats, etc.

The running container daemon 122 concurrently interfaces services of the set of running containers 123 with access functions of the running operating system 121 for controlling operation of the machine 51 of the spinning mill 5 by the set of the running containers 123. For example, one of the running containers 123 may relate to services for recipe management, wherein the running container daemon 122 interfaces respective recipe management services with access functions of the running operating system 121, for example for setting an actor signal, such as for setting a rotation speed. For example, one of the running containers 123 may relate to services for log collection, wherein the running container daemon 122 interfaces respective log collection services with access functions of the running operating system 121, for example for reading a sensor signal, such as for reading a doff time.

As illustrated in FIG. 1, the machine controller 1 further includes an update service 13 for updating container images 113 of the machine controller 1. The update service 13 enables updating one or more container images 113 at a time. Updating of the machine controller 1 is simplified, because updating is limited to specific container images 113, contrary to the prior art which suggests updating of application programs as a whole of machine controllers of a spinning mill. For example, in case of improved recipe management, only container images 113 are updated which include services for recipe management, contrary to the prior art which requires updating of the whole application program. Updating individual container images 113 reduces the risk of undesired side effects. Updating individual container images 113 reduces the need to touch "old code". In some embodiments, the update service 13 cooperates with an electronic device 2 as described in the present disclosure for updating container images 113.

In some embodiments, the update service 13 enables a push service and/or a pull service for updating container images 113. For example, the update service 13 cooperates with an electronic device 2 as described in the present disclosure, wherein the electronic device 2 pushes updates of container images 113 to the machine controller 1 (push service), for example as soon as updates are available. For example, the update service 13 checks at an electronic device 2 as described in the present disclosure whether updates of container images 113 are available, and pulls updates, if applicable (pull service), for example at regular time intervals.

In some embodiments, the update service 13 enables restarting a running container 123 after updating the respective container image 113. For example, the update service 13 enables shutting down a running container 123, receiving a respective updated container image 113 and storing the updated container image 113 in the storage 11, and restarting the updated container image 113 for providing an updated running container 123.

In some embodiments, the update service 13 enables to start an updated container image 113 in parallel with a respective previously running container 123, and to switch from the previously running container 123 to the updated running container 123 before shutting down the no longer needed previously running container 123. In other embodiments, the previously running container 123 is kept running for a predefined time period before shutting down the previously running container 123, for example after receipt of a confirmation, for example from a watchdog as described above, that the updated running container 123 runs correctly, and to switch back to the previously running container 123 in case of problems with the updated running container 123.

In some embodiments, the update service 13 is a part of the running operating system 121, the running container daemon 122 and/or one or more of the running containers 123. Some operating systems may have included update services, which may be used for updating container images 113. The running container daemon 122 may detect incompatibilities between a running operating system 121 and running containers 123, and initiate updating of container images 113, if applicable. One or more running containers 113 may include functions for updating container images 113.

In some embodiments, the running containers 123 provide for a service-oriented architecture and/or an event-driven architecture. Flexibly designing an environment with running containers 123 according to a predefined or desired architecture is enabled.

In a possible scenario, on the basis of a first running operating system 121 (respectively a first operating system code 111), a machine controller 1 has been properly configured for controlling operation of a machine 51 of a spinning mill 5, i.e., a set of container images 113 has been properly configured to provide running containers 123 providing required services for controlling operation of the machine 51 and a first container daemon code 112 has be properly configured for interfacing the running containers 123 with the first operating system 121. In order to make use of a second running operating system 121' (respectively a second operating system code 111'), it is sufficient to provide a second container daemon code 112' for interfacing the running containers 123 with the second running operating system 121', while the container code 113 of the running containers 123 can remain unchanged. The second running operating system 121' can relate to an existing operating system. The second running operating system 121' can relate to a new release of an operating system. Accordingly, making use of an existing operating system and/or adaption to a new release of an operating system are simplified.

Figure 2:
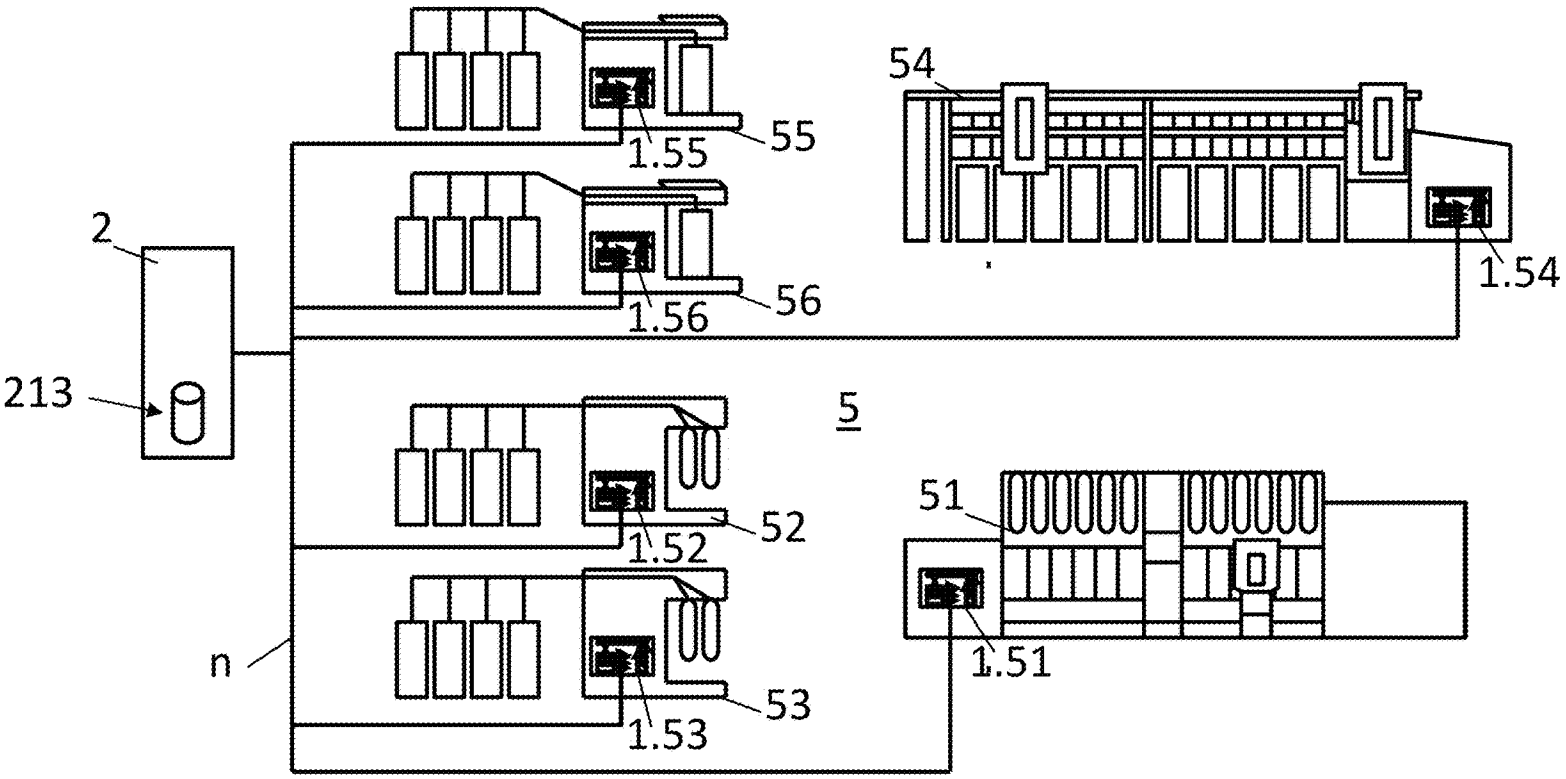
FIG. 2 schematically illustrates an electronic device for updating machine controllers for controlling operation of machines of a spinning mill.
Figure 2A:
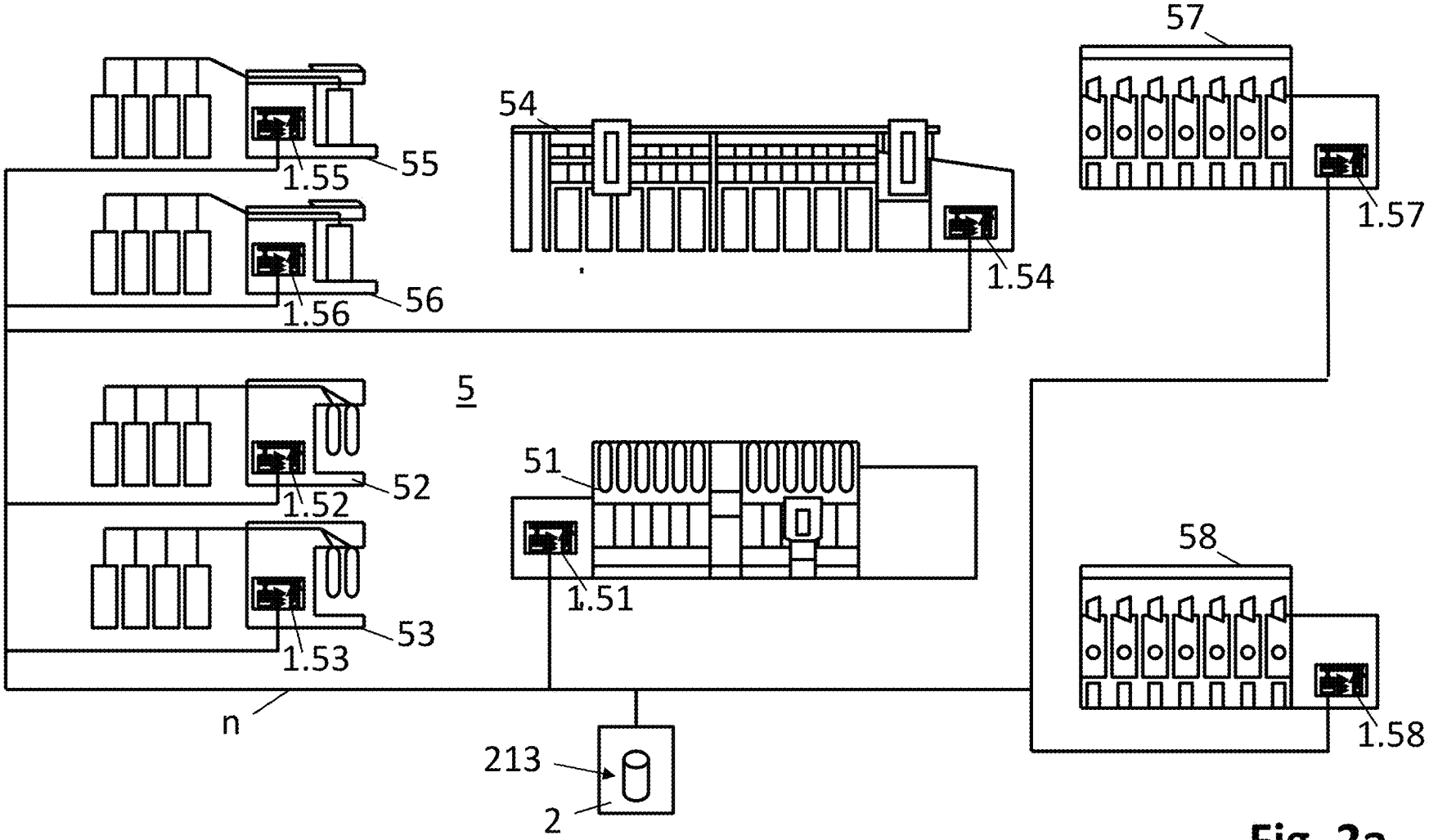
FIG. 2*a* schematically illustrates an electronic device for updating machine controllers for controlling operation of machines of an alternative configuration of a spinning mill.

FIG. 2 schematically illustrates an electronic device 2 for updating machine controllers 1.51, 1.52, 1.53, 1.54, 1.55, 1.56 for controlling operation of machines 51, 52, 53, 54, 55, 56 of a spinning mill 5. In the exemplary configuration illustrated in FIG. 2, the spinning mill 5 includes a ring spinning machine 51, an air jet spinning machine 54, two rowing frame machines 52, 53, and two draw frame machines 55, 56. However, the invention relates to any configuration of a spinning mill 5. For example, FIG. 2*a* illustrates a configuration of a spinning mill 5 which additionally includes winding machines 57, 58. The rowing frame machines 52, 53 and the draw frame machines 55, 56 receive textile material from upstream machines (not illustrated in FIG. 2, 2*a*), and deliver processed textile material to the ring spinning machine 51 and the air jet spinning machine 54, which deliver processed textile material to further downstream textile machines. For example, the ring spinning machine 51 delivers processed textile material to winding machines 57, 58 illustrated in FIG. 2*a*, which receive textile material from the ring spinning machine 51 in a first form of transportable textile assemblies, such as yarn wound on cops, for producing a second form of transportable textile assemblies, such as larger bobbins with rewound yarn. The spinning mill 5 may include one or more superordinated machine controllers (not illustrated in FIG. 2, 2*a*), such as a control room computer, for controlling operation of the machines 51, 52, 53, 54, 55, 56, 57, 58 of the spinning mill 5.

FIG. 2, 2*a* illustrates machine controllers 1.51, 1.52, 1.53, 1.54, 1.55, 1.56, 1.57, 1.58 which are included in respective machines 51, 52, 53, 54, 55, 56, 57, 58 of the spinning mill 5. However, machine controllers 1.51, 1.52, 1.53, 1.54, 1.55, 1.56, 1.57, 1.58 may be arranged externally from machines 51, 52, 53, 54, 55, 56, 57, 58 and/or machine controllers may be arranged for controlling operation of groups of machines of the spinning mill (not illustrated in FIG. 2, 2*a*).

Machine controllers 1.51, 1.52, 1.53, 1.54, 1.55, 1.56, 1.57, 1.58 are configured as described in the present disclosure, in particular as described in connection with FIG. 1.

The electronic device 2 is connected via network n with machine controllers 1.51, 1.52, 1.53, 1.54, 1.55, 1.56, 1.57, 1.58. Network n may relate to a wired or wireless network for transmitting electronic signals and/or electronic messages between the electronic device 2 and machine controllers 1.51, 1.52, 1.53, 1.54, 1.55, 1.56, 1.57, 1.58.

The electronic device 2 and the network n may relate to a computerized device and a computerized network. The computerized network may relate to a wired network, a wireless network, etc. The computerized network enables transmission of control signals, monitor signals, electronic messages, etc. between the electronic device 2 and the machine controllers 1.51, 1.52, 1.53, 1.54, 1.55, 1.56, 1.57, 1.58. For example, network n may relate to an IP (Internet Protocol) network, for example enabling transmission control protocol (TCP) streams and/or user datagram protocol (UDP) datagrams. The computerized device may relate to a microcontroller, a computer, etc. The computerized device may include one or more processors and program instructions stored in a memory, which program instructions, when executed by the one or more processors, provide the functions as described in the present disclosure. The electronic device may include a user interface such as graphical user interfaces (GUI) for enabling displaying information to an operator and/or for enabling receiving commands from an operator. For example, the electronic device 2 may relate to a control and monitoring device of a spinning mill.

In some embodiments, the electronic device 2 is arranged within the spinning mill 5 (EDGE). In some embodiments, the electronic device 2 is arranged on a server arranged in the Internet (CLOUD). In some embodiments, the electronic device 2 relates to a distributed system, wherein a container repository 213 as described further below is arranged in the CLOUD, which becomes cached in the EDGE for distributing updates on the machines.

As illustrated in FIG. 2, 2*a*, the electronic device 2 has access to a container repository 213. The container repository 213 may relate to a storage of the electronic device 2, in particular a non-volatile storage such as a HDD, SSD, etc. The container repository 213 may relate to a database. The container repository 213 may be arranged remote from the electronic device 2, for example in a datacenter of a customer, of a supplier, of a cloud server, etc., wherein access is to the container repository 213 is enabled via a network (not illustrated in FIG. 2, 2*a*).

The container repository 213 has stored a plurality of container images. The electronic device 2 is configured to access one or more container images from the container repository 213 for updating respective container images of machine controllers 1.51, 1.52, 1.53, . . . . For example, the electronic device 2 contacts a machine controller 1.51, requests information about a particular container image stored in the storage of the machine controller 1.51, and transmits an updated container image from the container repository 213 to the machine controller 1.51, if applicable.

The container images stored in the container repository 213 and stored in the machine controllers 1.51, 1.52, 1.53, . . . may include unique identification information, such as a version number, an image hash, machine information, machine controller information, interface specification, etc. for differentiating container images. For example, identification information may enable differentiating container images as regards updated features, bug fixes, etc. Container images may be designed for a particular machine type, machine controller version, etc. Container images may be the same for all machines or for a group of machines/models, etc. For example, a machine controller for controlling operation of a bale opener may include different electronic circuits than a machine controller for controlling operation of a ring spinning machine, wherein different container images are required for controlling operation. For example, machine controllers may differ in their storage and/or memory spaces, processor performances, etc., wherein particular container images may require specific limits as regards for example a minimal amount of memory, a minimal processor performance, etc.

The electronic device 2 may access container images stored in the container repository 213 based on a verification of a version number, a type identifier of respective machine controllers, a version number of respective machine controllers, etc. Accordingly, the electronic device 2 enables adapting the update of container images to respective machine controllers, to container images already stored in machine controllers, etc.

In some embodiments, the electronic device 2 is configured to provide a push service and/or a pull service for updating container images of machine controllers 1.51, 1.52, 1.53, . . . . For example, the electronic device 2 may detect installation of an updated container image in the container repository 213, which for example is performed manually by a machine operator, and accordingly transmit respective container images to respective machine controllers (push service). For example, the update service at a machine controller service may detect an idle running container, may check and request for a respective updated container image at the electronic device 2, and, if applicable, may shut down the idle running container and may restart the updated container image for providing an updated running container (pull service).

Figure 3:
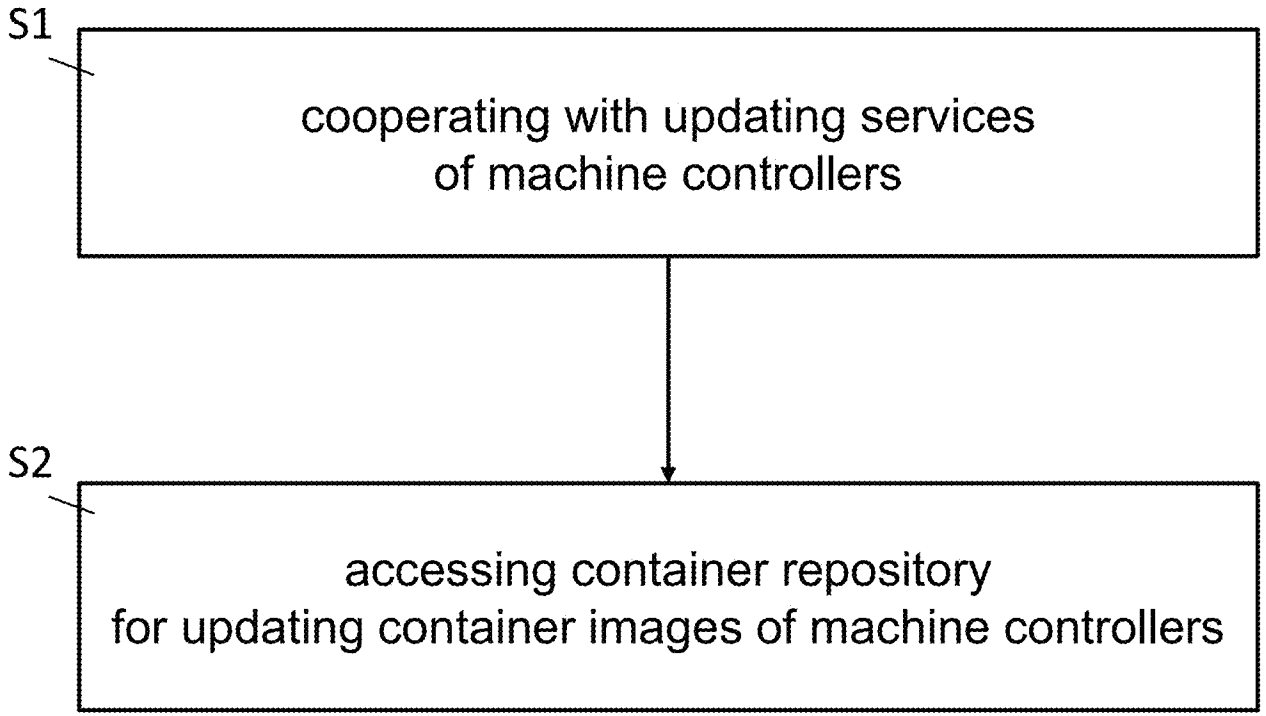
FIG. 3 schematically illustrates possible method steps for updating machine controllers for controlling operation of machines of a spinning mill.

FIG. 3 schematically illustrates possible method steps for updating machine controllers 1.51, 1.52, 1.53, . . . for controlling operation of machines 51, 52, 53, . . . of a spinning mill 5. The method comprises at an electronic device 2 as described in the present disclosure cooperating with one or more update services 13 of machine controllers 1.51, 1.52, 1.53, . . . as described in the present disclosure. The method further comprises at the electronic device 2 accessing the container repository 213 of the electronic device 2 for updating respective container images of machine controllers 1.51, 1.52, 1.53, . . .

The present invention is not limited to the embodiments shown and described. Modifications within the scope of the claims are possible, as is a combination of the features, even if these are shown and described in different embodiments.

REFERENCE NUMERALS/SIGNS

1 machine controller
11 storage
111 operating system code
112 container daemon code
113 container images
12 processor section
121 running operating system
122 running container daemon
123 running containers
13 update service
5 spinning mill
51, 52, 53, . . . machines of the spinning mill

1.51, 1.52, 1.53, . . . machine controllers of machines of the spinning mill

2 electronic device

213 container repository

The invention claimed is:

1. A machine controller for controlling operation of a machine of a spinning mill, the machine controller comprising:

a storage that stores operating system code, container daemon code, and a plurality of container images;

a processor section configured to perform the following:

provide a running operating system based on the operating system code;

provide a running container daemon based on the container daemon code;

provide running containers based on the plurality of container images;

wherein the running operating system includes access functions for accessing the machine of the spinning mill;

wherein each one of a set of the running containers provides a service for controlling operation of the machine of the spinning mill;

wherein the running container daemon concurrently interfaces services of the set of the running containers with access functions of the running operating system for controlling operation of the machine of the spinning mill by the set of the running containers; and wherein the machine controller further includes an update service that updates the container images of the machine controller.

2. The machine controller of claim 1, wherein the update service enables one or more of a push service or a pull service for updating the container images.

3. The machine controller of claim 1, wherein the update service is configured to enable one or more of:

stopping one or more of the running containers;

starting one of the container images;

restarting one or more of the running containers after the updating thereof;

perform a predefined verification after starting one or more of container images; or perform a predefined verification after restarting one or more of running container images.

4. The machine controller of claim 1, wherein the update service is a part of one or more of: the running operating system; the running container daemon; or one or more of the running containers.

5. The machine controller of claim 1, wherein the processor section is further configured to provide a further set of running containers that operate and administer one or more of the container images, the container daemon code, the operating system code, the running containers, the running container daemon, the running operating system, or the machine of the spinning mill.

6. The machine controller of claim 1, wherein one or more of the running containers provide a service for: basic machine control; recipe management; user management; log collection; alerts; notifications; shift service; or distributed processing.

7. The machine controller of claim 1, wherein one or more of the running containers provide a service for controlling operation of: a bale opener machine; a blow room machine; a card machine; a draw frame machine; a comber machine; a roving frame machine; a ring spinning machine; a compact spinning machine; a rotor spinning machine; an air-jet spinning machine; an automation machine; a winding machine; or a texturing machine.

8. The machine controller of claim 1, wherein the running containers provide for one or more of a service-oriented architecture or an event-driven architecture.

9. A system configured for controlling operation of spinning mill machines, comprising:

a plurality of spinning mill machines, each of the spinning mill machines comprising a machine controller;

each of the machine controllers comprising:

a storage that stores operating system code, container daemon code, and a plurality of container images;

a processor section configured to perform the following:

provide a running operating system based on the operating system code;

provide a running container daemon based on the container daemon code;

provide running containers based on the plurality of container images;

wherein the running operating system includes access functions for accessing the spinning mill machine;

wherein each one of a set of the running containers provides a service for controlling operation of the spinning mill machine;

wherein the running container daemon concurrently interfaces services of the set of the running containers with access functions of the running operating system for controlling operation of the spinning mill machine by the set of the running containers;

an update service that updates the container images; and an electronic device in communication with the machine controllers and comprising a container repository configured for update the container images of the machine controllers.

10. The system of claim 9, wherein the container repository is configured to be accessed based on one or more of: a version number of container images; a type identifier of the machine controllers; or a version number of the machine controllers.

11. The system of claim 9, wherein the electronic device is configured to update the container images upon receipt of updated container images at the container repository.

12. The system of claim 9, wherein the electronic device is configured to update respective container images upon request from the machine controllers.

13. A method for updating container images of machine controllers of spinning mill machines, the method comprising:

using the system according to claim 9 to:

cooperating with one or more update services;

accessing the container repository of the electronic device for updating respective container images of the machine controllers.

14. The method according to claim 13, wherein the process of accessing the container repository of the electronic device is based on one or more of: a version number of the container images; a type identifier of the respective machine controllers; or a version number of the respective machine controllers.

* * * * *